US007600278B2

(12) United States Patent
Oh

(10) Patent No.: US 7,600,278 B2
(45) Date of Patent: Oct. 13, 2009

(54) FOLDING BED FRAME

(75) Inventor: Suk Kan Oh, Xiamen (CN)

(73) Assignee: Zinus, Inc., Pleasanton, CA (US)

( * ) Notice: Subject to any disclaimer, the term of this patent is extended or adjusted under 35 U.S.C. 154(b) by 0 days.

(21) Appl. No.: 12/287,440

(22) Filed: Oct. 8, 2008

(65) Prior Publication Data

US 2009/0100597 A1 Apr. 23, 2009

(51) Int. Cl.
*A47C 19/12* (2006.01)
*A47C 19/04* (2006.01)

(52) U.S. Cl. ..... 5/201; 5/8; 5/202; 5/174; 5/177; 5/181

(58) Field of Classification Search ..... 5/201, 5/8, 202, 174, 177, 181, 184, 185, 200.1
See application file for complete search history.

(56) References Cited

U.S. PATENT DOCUMENTS 1,350,327 A * 8/1920 Moir ..... 5/172
3,161,894 A * 12/1964 Short ..... 5/296
4,128,907 A * 12/1978 Gelbart ..... 5/200.1
6,047,422 A * 4/2000 Yousif ..... 5/661
6,560,796 B1 * 5/2003 Diforio ..... 5/200.1
7,134,154 B2 * 11/2006 Cloer et al. ..... 5/201

OTHER PUBLICATIONS

Website of Glideaway Sleep Products, page showing "Fasten up kit 6A" used to allow bolt on end plate to be converted to hook-up end plate, downloaded from www.glideaway.com/Products/ on Oct. 7, 2008. (3 pages).

* cited by examiner

*Primary Examiner*—Alexander Grosz
(74) *Attorney, Agent, or Firm*—Imperium Patent Works; Darien K. Wallace; T. Lester Wallace

(57) ABSTRACT

A folding bed frame includes standardized right and left bed frame assemblies that are connectable by central connecting bars to form an adjustable bedboard frame that fits mattresses of differing widths. The bed frame is easy to transport when disassembled into the separate frame assemblies that are each less than half the width of a conventional frame for a double bed. The smaller and standardized frame assemblies reduce manufacturing cost. Foot brackets are pivotally connected to the bottom of the bedboard frame under each bed frame assembly and support the bedboard frame and mattress. Each central connecting bar has U-shaped slots on its ends that clip over the inner side edges of the right and left bed frame assemblies. Each frame assembly has a hinge at its middle axis at which a lower half folds over onto an upper half to allow the assemblies to fit in a packing box.

8 Claims, 6 Drawing Sheets

FOLDING BED FRAME

CROSS REFERENCE TO RELATED APPLICATION

This application is based on and hereby claims the benefit under 35 U.S.C. §119 from Chinese Patent Application No. 200720008515.1, filed on Oct. 19, 2007, in China, the contents of which are hereby incorporated by reference. This application is a continuation-in-part of Chinese Application No. 200720008515.1.

TECHNICAL FIELD

The described embodiments relate to bedding products, and more particularly to a bed frame.

BACKGROUND INFORMATION

Conventional folding bed frames are relatively heavy and awkward. FIG. 1 (prior art) shows the structure of a conventional folding bed frame including a mattress frame 1 and support legs 2. Mattress frame 1 can be folded in half. The plurality of support legs 2 are pivotally connected under the mattress frame 1. In use, a mattress (not shown) is placed on the mattress frame 1. This structure of the folding bed frame must possess a certain level of bearing strength because the mattress frame 1 must support the mattress. In order to provide bearing strength, mattress frame 1 is made with relatively thick cross-bars and thinner longitudinal bars. The thick crossbars have relatively large intervals between them, whereas the thinner longitudinal bars are spaced at relatively small intervals. The thick cross-bars and the thinner longitudinal bars are both welded to mattress frame 1. Although the bed frame of figure 1 provides stable support for a mattress, the bed frame is awkward and bulky. Because this type of bed frame is typically made of metal, the crossed design of the thick cross-bars and the longitudinal bars increases the weight of the bed frame even further. Especially in the case of a double-bed that supports a queen or king sized mattress, the bed frame is even more awkward and difficult to carry and transport In addition, the bed frame of FIG. 1 is not adaptable to different mattress sizes. Even a conventional bed frame that is sized for either a single bed or a double bed does not accommodate the various dimensions of the single and double mattresses, such as single, twin, full, double, queen, king and California king. A different bed frame size must be manufactured to accommodate each different mattress dimension. Because the bed frame of FIG. 1 cannot be standardized to fit multiple mattress dimensions, the manufacturing cost of the various sizes of the bed frame is increased.

A bed frame is sought that is lighter and less awkward than the conventional bed frame and that can accommodate multiple mattress dimensions.

SUMMARY

A folding bed frame includes standardized right and left bed frame assemblies. The bed frame assemblies are connected by a plurality of central connecting bars to form an adjustable bedboard frame that can accommodate mattresses of differing widths. The small, standardized bed frame assemblies can be manufactured at less cost than the conventional unitary bed frame. In addition, the folding bed frame is easy to transport when disassembled into the separate frame assemblies that are each less than half the width of a conventional bed frame for a double bed. The bedboard frame formed by the standardized frame assemblies and the central connecting bars is lighter than the conventional unitary bed frame and is therefore less expensive to transport and easier to install.

Foot brackets are pivotally connected to the bottom of the bedboard frame under each bed frame assembly and support the bedboard frame and mattress. Each central connecting bar has U-shaped slots on its ends that clip over the inner side edges of the right and left bed frame assemblies. Each frame assembly has a hinge at its middle axis at which a lower half of the assembly folds over onto an upper half of the assembly to allow the frame assemblies to fit in a packing box. The foot brackets fold in to fit in the packing box.

Edge attachments are attached by screws to the upper left corner of the left bed frame assembly and to the upper right corner of right bed frame assembly. A headboard of the bed attaches to the edge attachments of the folding bed frame. Tongues on the headboard slip into slots in the edge attachments.

A method of packing the folding bed frame into a packing box involves folding lower halves of the bedboard frames of bed frame assemblies over onto upper halves of the bedboard frames. The foot brackets that are pivotally connected to the bedboard frames are folded in. The folded bedboard frames are then inserted into a packing box that is about half as long as the unfolded bedboard frames. The packing box has a width of little more than the width of one bed frame assembly. The packing box is about four times as thick as the folded in foot brackets plus four times as thick as an unfolded bedboard frame. Central connecting bars are inserted into the packing box and fit box between the folded-in foot brackets.

In one embodiment, the folding bed frame includes no central connecting bars. The folding bed frame includes right and left bed frame assemblies. The right bed frame assembly has a left inner side edge that faces the left bed frame assembly, and the left bed frame assembly has-a right inner side edge that faces the right bed frame assembly. The left inner side edge is directly connected to the right inner side edge and forms a bedboard frame for a single bed.

An apparatus includes a packing box and a means for assembling a bed frame that fits mattresses of differing widths. The means is inserted into the packing box. The bed frame is adaptable to fit a mattress having an area that is larger than four times the length times the width of the packing box.

A folding bed frame at least comprises mutually connected left and right bed frame assemblies, one on each side. Each bed frame assembly includes a bedboard frame and a plurality of foot brackets that are pivotally connected under the bedboard frame. In one aspect, a bedboard frame for a single bed is provided in which no central connecting bars are used. In another aspect, a plurality of central connecting bars span between the left and right bed frame assemblies. Central connecting bars with different lengths are selected to accommodate mattresses of different widths. Thus, a bedboard frame for double beds with different widths can be conveniently manufactured without the need to re-manufacture the bed frame assemblies. The specifications of the bed frame assemblies are standardized, which greatly reduces the manufacturing cost of the folding bed frame.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

DETAILED DESCRIPTION

A less costly folding bed frame is disclosed that can accommodate mattresses of various dimensions. A standardized bed frame-is provided that can be conveniently adjusted to various mattress widths. The folding bed frame includes a left bed frame assembly and a right bed frame assembly connected by a plurality of central connecting bars. The assembled bed frame forms a bedboard frame and a plurality of legs that are pivotally connected under the bedboard frame. The central connecting bars form part of the bedboard frame and connect the left bed frame assembly to the right bed frame assembly. Each end of each central connecting bar has a U-shaped slot opening downwardly. A U-shaped slot is clipped down over the inner side edge of a bed frame assembly. In one embodiment, the left and right bed frame assemblies are connected to each other via the central connecting bars through riveting or screwing.

The combined width of the pair of bed frame assemblies is narrower than the width of a traditional folding bed frame for a double bed. By connecting the left and right bed frame assemblies directly to each through bolts, riveting or screwing without using the central connecting bars, a frame for a single bed is provided. A frame for a double bed is provided by spanning the plurality of central connecting bars between the left and right bed frame assemblies. Thus, the standardized left and right bed frame assemblies are adaptable to form frames for mattresses of various dimensions. In addition, the standardized left and right bed frame assemblies reduce the cost of manufacturing bed frames that accommodate different sized mattresses.

Because the central connecting bars are independent of the standardized left and right bed frame assemblies, the lengths of the bars can be easily varied. Bed frames that can accommodate different widths of mattresses can be manufactured simply by producing central connecting bars with different lengths. Central connecting bars having a specified length can be selected to match the width requirement of each bed without the need to re-manufacture a bedboard frame. Thus, the novel bed frame has a greatly reduced manufacturing cost.

Especially when configured as a frame for a double bed, the novel folding bed frame is much lighter than conventional folding bed frames with cross and longitudinal bars. The weight of the central connecting bars is less than that of the welded cross and longitudina1 bars.

The novel folding bed frame is also easier to transport than a conventional folding bed frame. Conventional frames have a single mattress frame whose size hampers the ease of transport. The novel bed frame is divided into two bed frame assemblies connected by central connecting bars. The novel bed frame can be disassembled into the two separate bed frame assemblies that are easier to carry and transport.

Figure 1:
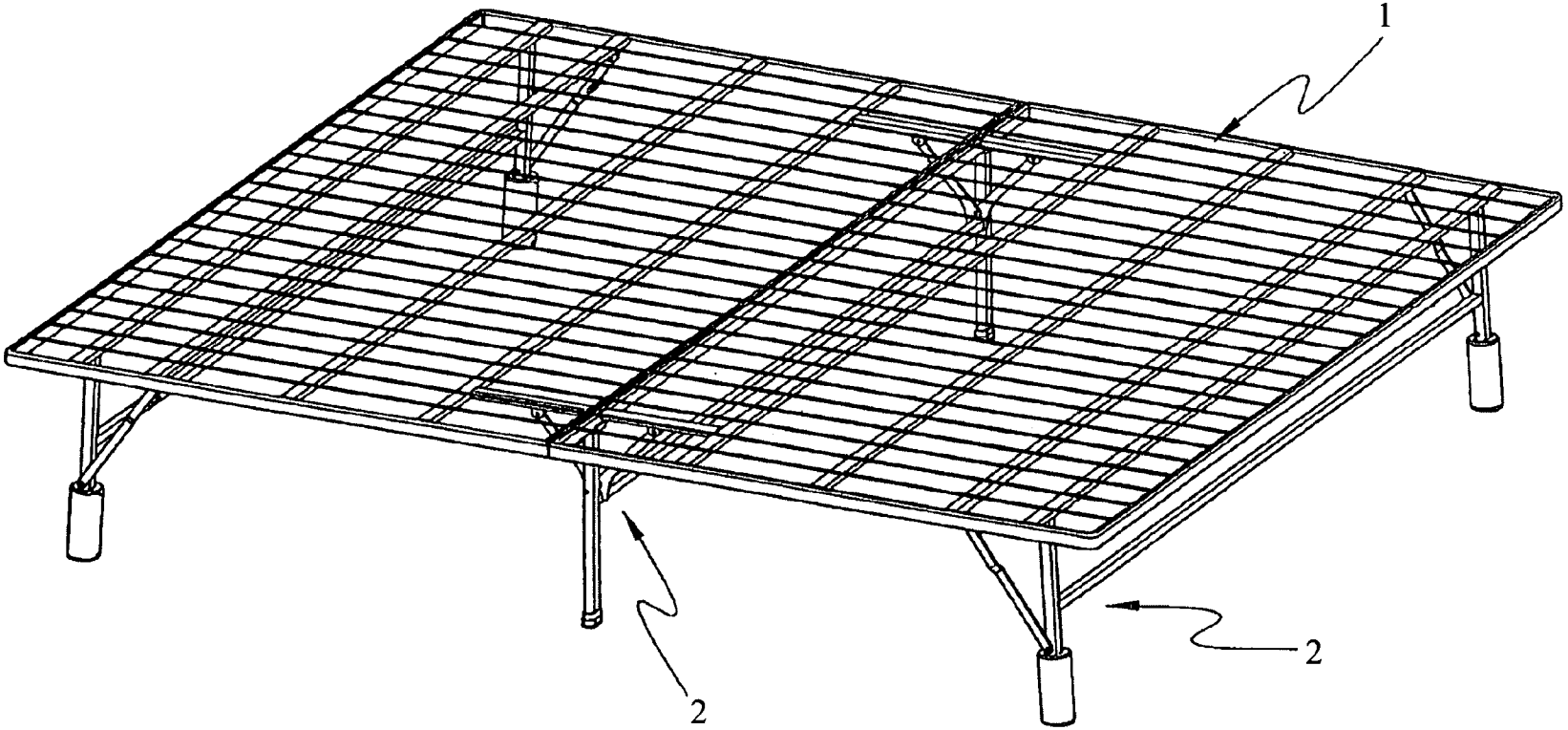
(PRIOR ART) FIG. 1
FIG. 1 (prior art) is a schematic view of a conventional folding bed frame.
Figure 2:
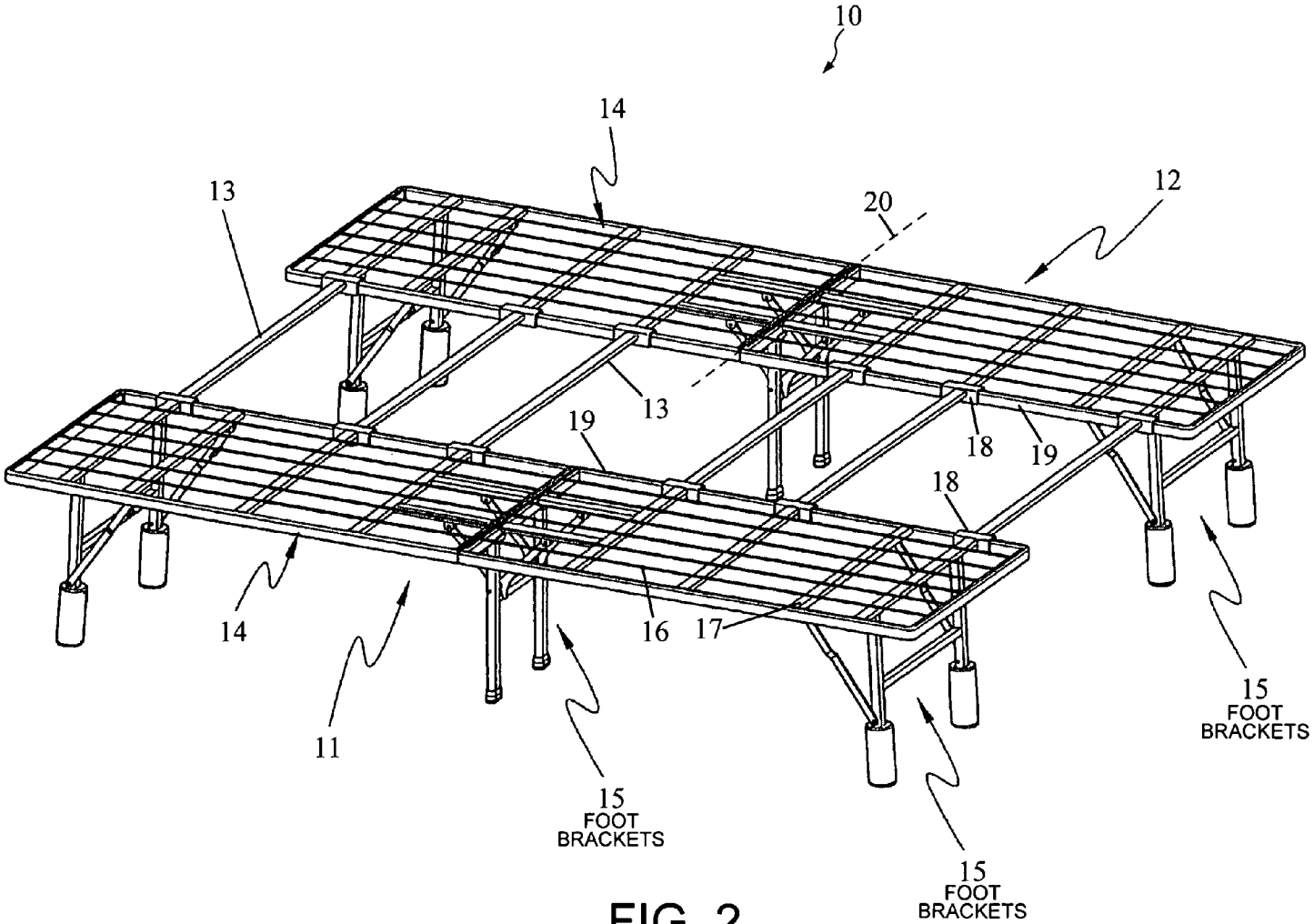
FIG. 2 is a schematic view of a novel folding bed frame according to the invention, including central connecting bars.

FIG. 2 shows a novel folding bed frame 10 that can accommodate mattresses of differing dimensions. Bed frame 10 includes a left bed frame assembly 11, a right bed frame assembly 12, and a plurality of central connecting bars 13. Each of frame assemblies 11 and 12 resembles a very narrow folding bed frame. As shown in figure 2, each of frame assemblies 11 and 12 has a substantial width adapted to support a substantial portion of a mattress or the like. Each of frame assemblies 11 and 12 includes a bedboard frame 14 and a plurality of foot brackets 15 pivotally connected under the bedboard frame 11. The bed frame assemblies 11 and 12 stand upon the foot brackets 15 when the foot brackets are folded out and locked. A bedboard frame is formed by longitudinal bars 16 welded to lateral cross bars 17. In one embodiment, the longitudinal bars 16 are metal rods. Each foot bracket 15 includes two legs. Three exemplary foot brackets 15 are labeled in figure 2. Left bed frame assembly 11 differs from a conventional folding bed frame in that assembly 11 is narrower, normally less than half the width of a frame for a double bed.

Figure 3:
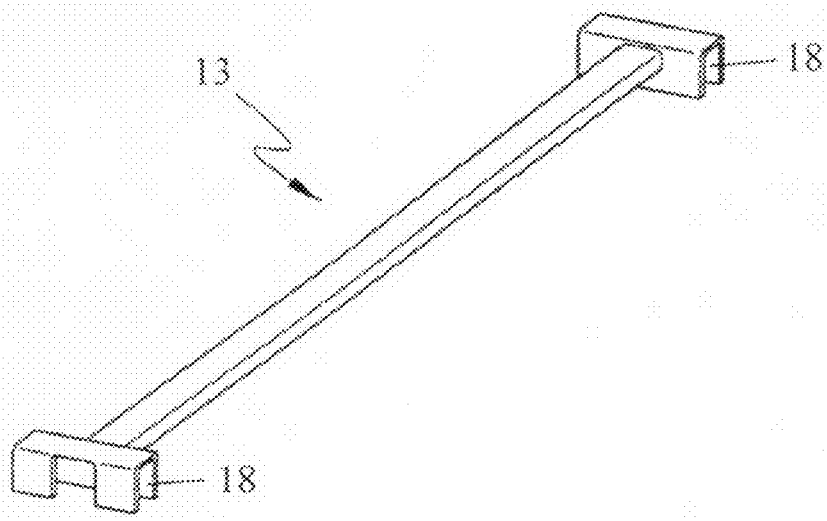
FIG. 3 is a more detailed view of one of the central connecting bars of the folding bed frame of FIG. 2.

FIG. 3 shows an exemplary central connecting bar 13 in more detail. Each central connecting bar is disposed between left bed frame assembly 11 and right bed frame assembly 12. Both ends of each central connecting bar 13 have a U-shaped slot 18 opening downward. The U-shaped slot 18 is clipped down over an inner side edge 19 of one of frame assemblies 11 or 12.

In another embodiment, the connection between the end of a central connecting bar 13 and an inner side edge 19 is made by inserting a narrow tip of the connecting bar through a hole in the side edge 19. Alternatively, the end of a central connecting bar 13 is bolted to the side edge 19. Other connection means can also be used to connect the central connecting bars to the inner side-edges.

Folding bed frame 10 is shipped from the manufacturer to retail stores in a disassembled condition. Typically, a customer also purchases folding bed frame 10 in a disassembled condition and assembles the bed frame at home in the bedroom where the bed frame will be used. All of the disassembled pieces of folding bed frame 10 fit in a packing box having a length that is about half the length of each bed frame assembly. In the packing box, each bed frame assembly is folded at its middle axis 20, which is hinged. For example, the lower half of each bed frame assembly is folded over onto the upper half of the frame assembly in order to fit in the packing box. The packing box has a width of little more than the width of one bed frame assembly. The thickness of the box is about four times the thickness of the bedboard frame plus four times the thickness occupied by a folded foot bracket 15. The central connecting bars fit in the packing box between the folded-in foot brackets. Thus, the area defined by the length and width of the packing box is less than a quarter of the area of the mattress that fits on the bedboard frame formed by the bed frame assemblies and the central connecting bars.

To assemble bed frame 10, bed frame assemblies 11 and 12 are first deployed. The bedboard frame 14 of each bed frame assembly is unfolded, and the three foot brackets 15 of each frame assembly are folded out and locked. Right bed frame assembly 12 is placed to the right of left bed frame assembly 11. Next, the plurality of central connecting bars 13 are fixedly clipped onto the inner edges 19 of left and right bed frame assemblies 11 and 12 such that the bars transversely span between the left and right bed frame assemblies 11 and 12. The U-shaped slots 18 are clipped down over the metal bars that form the inner edges 19. Next, edge attachments 21 (not shown in FIG. 2) are attached by screws to the upper left corner of left bed frame assembly 11 and to the upper right corner of right bed frame assembly 12.

Figure 4:
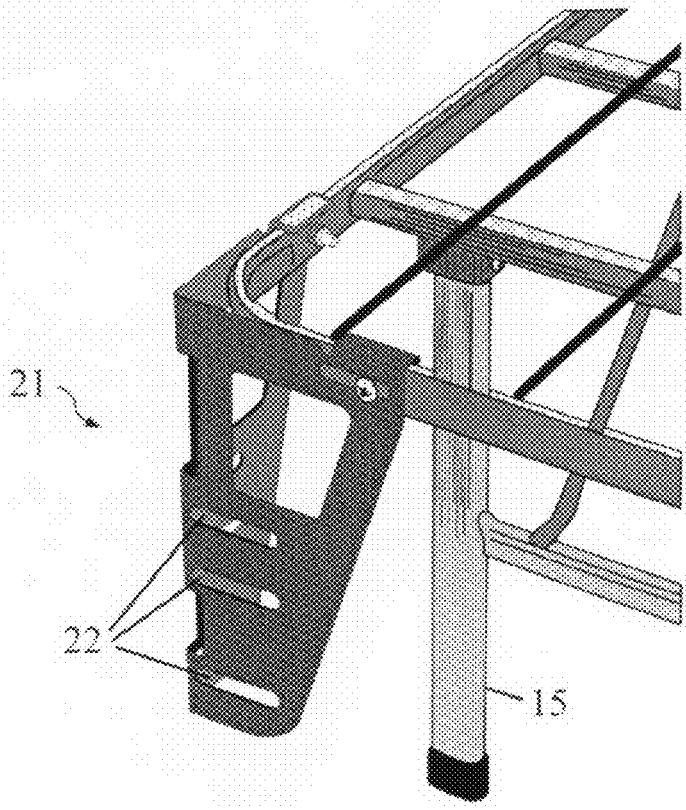
FIG. 4 is a schematic view of an edge attachment of the bed frame of FIG. 2 to which a headboard can be attached.

FIG. 4 shows the edge attachment 21 attached to the upper right corner of right bed frame assembly 12. In this embodiment, edge attachment 21 clips over an upper side edge as well as over an outer side edge of right bed frame assembly 12. Then edge attachment 21 is screwed in and hangs down from the side edge of right bed frame assembly 12. A headboard is attached to the edge attachments. Tongues on the headboard slip into slots 22 in edge attachment 21.

Figure 5:
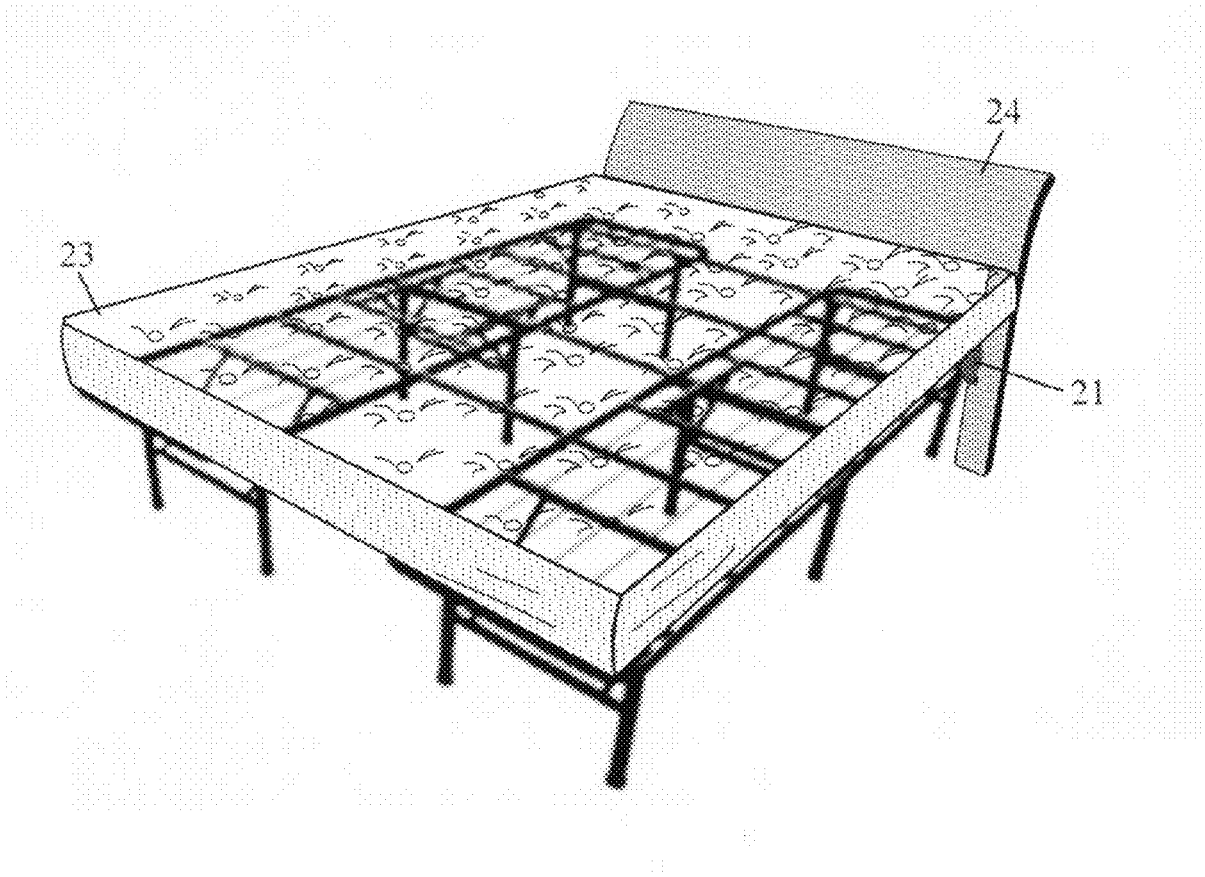
FIG. 5 is a perspective, cut-away view of a king sized mattress placed on the folding bed frame of FIG. 2.

FIG. 5 shows a king sized mattress 23 placed on 14 bedboard frame 14 of folding bed frame 10. A headboard 24 is attached to edge attachments 21. FIG. 5 illustrates that the area of bedboard frame 14 formed by the longitudinal bars 16 and lateral cross bars 17 is limited to the sides where the bed frame assemblies are located. The central area of bedboard frame 14 is formed by the central connecting bars 13. Because the weight of the central connecting bars 13 is less than that of the longitudinal bars 16 and lateral cross bars 17, folding bed frame 10 is lighter and less awkward. Folding bed frame 10 is also less awkward than conventional bed frames because the size of the disassembled, folded bed frame inside the packing box is smaller and can be more easily fit inside the trunk of a car or through a doorway.

Left and right bed frame assemblies 11 and 12 provide support on the side edges of mattresses of every width. Edge support is beneficial, as consumers tend to sit on the side of a mattress before getting in and out of bed. In one embodiment, some unsupported length remains at the bottom of the mattress because the length of left and right bed frame assemblies 11 and 12 fits the length of a single mattress, and a bedboard is attached to the top of the bed frame assemblies.

In addition, the manufacturing cost of folding bed frame 10 is reduced because bed frame assemblies 11 and 12 are standardized, and the length of the central connecting bars 13 can be adjusted. In one embodiment, central connecting bars 13 having a length that is appropriate for the width of a certain mattress are included in the packing box. For example, shorter connecting bars are included in the packing box of a bed frame for a queen sized mattress than are included in the box for a king sized mattress. In another embodiment, the central connecting bars are conveniently adjustable by allowing one side of each connecting bar to telescope into the other side of the connecting bar. A screw from the outer bar then tightens into the inner bar to fix the length of the connecting bar. Alternatively, a connecting bar is made adjustable by sliding a smaller U-shaped bar inside a larger, outer U-shaped bar.

Figure 6:
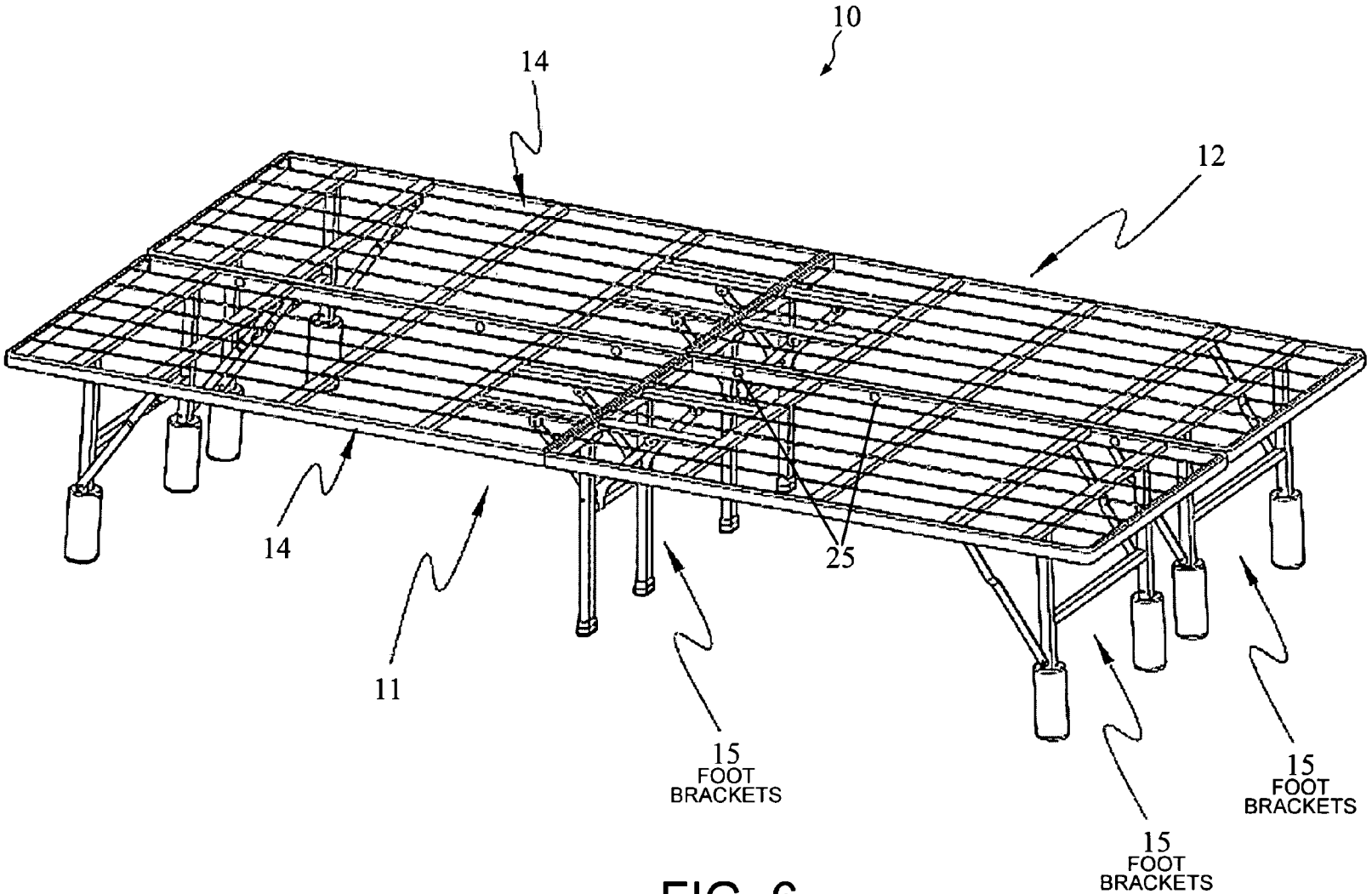
FIG. 6 is a schematic view of another embodiment of the folding bed frame of FIG. 2.

FIG. 6 shows another embodiment of folding bed frame 10 in which no central connecting bars are used. Left and right bed frame assemblies 11 and 12 are placed directly adjacent to each other. The inner side edges 19 of the bed frame assemblies 11 and 12 are attached to each other by bolts 25 and nuts. Alternatively, the bed frame assemblies 11 and 12 can be connected by screws or rivets. The bed frame of FIG. 6 has a width that is appropriate for a narrow mattress, such as an extra-long college twin mattress that measures 38 inches by 84 inches. Thus, the same standardized bed frame assemblies 11 and 12 form a bedboard frame 14 that supports mattresses of different dimensions. Not only is the manufacturing cost reduced, but the disassembled folding bed frame can be more conveniently packaged and transported.

Figure 7:
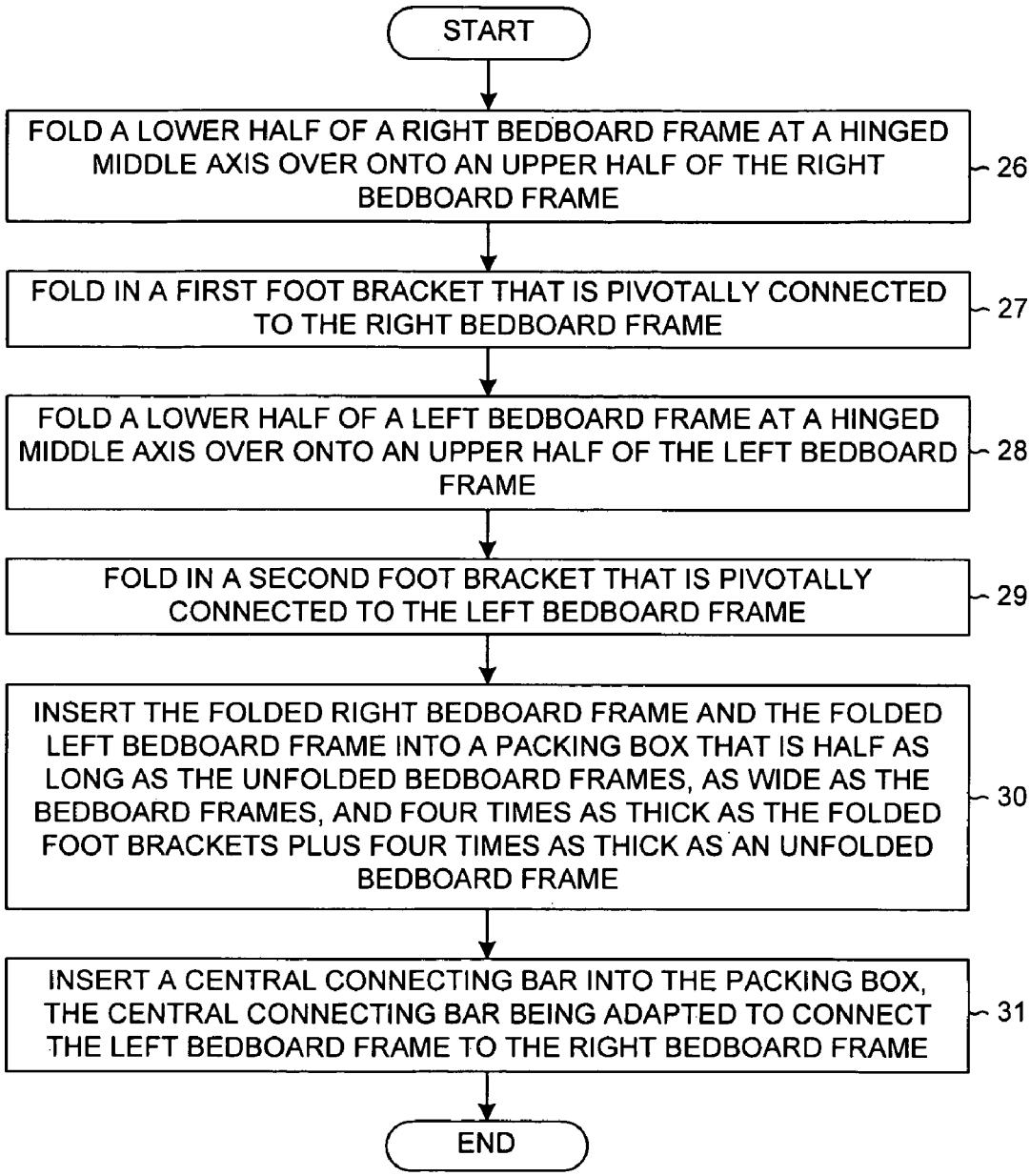
FIG. 7 is a flowchart illustrating steps of a method of packing the folding bed frame of FIG. 2 into a packing box.

FIG. 7 is a flowchart illustrating steps 26-31 of a method of packing folding bed frame 10 into a packing box that is conveniently sized for transporting. In a first step 26, a lower half of the bedboard frame 14 of right bed frame assembly 12 is folded over onto an upper half of the bedboard frame. Bedboard frame 14 is folded over at a hinge at middle axis 20.

In step 27, a first foot bracket 15 that is pivotally connected to the bedboard frame 14 of right bed frame assembly 12 is folded in. In step 28, a lower half of the bedboard frame 14 of left bed frame assembly 11 is folded over onto an upper half of the bedboard frame. In step 29, a second foot bracket 15 that is pivotally connected to the bedboard frame 14 of left bed frame assembly 11 is folded in. In step 30, the folded bedboard frame of right bed frame assembly 12 and the folded bedboard frame of left bed frame assembly 11 are inserted into a packing box. The packing box is about half as long as the unfolded bedboard frame of right bed frame assembly 12. The packing box has a width of little more than the width of right bed frame assembly 12. The packing box is about four times as thick as the folded first foot bracket plus four times as thick as the unfolded bedboard frame of right bed frame assembly 12. In step 31, a central connecting bar 13 is inserted into the packing box. The central connecting bar 13 is adapted to connect the bedboard frame of left bed frame assembly 11 to the bedboard frame of right bed frame assembly 12.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A bed frame comprising:

a right bed frame assembly, wherein said right bed frame assembly has a hinge at its middle axis at which a lower half of said right bed frame assembly can fold over onto an upper half of said right bed frame assembly;

a left bed frame assembly; and a plurality of central connecting bars that releasably connect said left bed frame assembly to said right bed frame assembly, said right and left bed frame assemblies having a substantial width adapted to support a substantial portion of a mattress or the like, wherein said right bed frame assembly, said left bed frame assembly and said plurality of central connecting bars form a bedboard frame, and wherein a foot bracket is pivotally connected to said right bed frame assembly under said bedboard frame.

2. The bed frame of claim 1, wherein said right bed frame assembly has an inner side edge that faces said left bed frame assembly, wherein one of said central connecting bars has a U-shaped slot on one end, and wherein said U-shaped slot is clipped over said inner side edge of said right bed frame assembly.

3. The bed frame of claim 1, further comprising:

an edge attachment to said right bed frame assembly, wherein said edge attachment clips over both an upper side edge and an outer side edge of said right bed frame assembly, and wherein said edge attachment is adapted to hold a headboard of a bed.

4. The bed frame of claim 3, wherein said edge attachment has slots, and wherein tongues on said headboard slip into said slots in said edge attachment.

5. The bed frame of claim 1, wherein one of said central connecting bars has a length that can be adjusted.

6. The bed frame of claim 1, wherein one of said central connecting bars has a first side and a second side, and wherein said central connecting bar has a length that is adjustable by allowing said first side to telescope into said second side.

7. The bed frame of claim 1, wherein said bedboard frame is adjusted to accommodate mattresses of differing widths by using central connecting bars of differing lengths.

8. The bed frame of claim 1, wherein said right bed frame assembly comprises longitudinal bars welded to lateral cross bars.

* * * * *